United States Patent [19]

Krieger

[11] 4,141,084

[45] Feb. 27, 1979

[54] WELT FOR CLOTH ARTICLES

[76] Inventor: Charles Krieger, 60 E. End Ave., New York, N.Y. 10022

[21] Appl. No.: 854,425

[22] Filed: Nov. 23, 1977

[51] Int. Cl.[2] ..... A41D 27/20

[52] U.S. Cl. ..... 2/247

[58] Field of Search ..... 2/247, 248, 249, 250, 2/251, 252, 253, 254, 255, 256

[56] References Cited

U.S. PATENT DOCUMENTS

| | | | |
|---|---|---|---|
| 1,946,173 | 2/1934 | Miller et al. | 2/248 |
| 2,968,813 | 1/1961 | Bachaach | 2/248 |

*Primary Examiner*—Werner H. Schroeder
*Assistant Examiner*—Doris L. Troutman
*Attorney, Agent, or Firm*—Kirschstein, Kirschstein, Ottinger & Cobrin

[57] ABSTRACT

A method of making a welt for clothing or the like, and the article of manufacture used for making the welt. The article consists essentially of three panels, of which first and second panels are thin generally rectangular panels which are of substantially equal size and which are adhered to each other in registered alignment. The first panel is composed of cloth i.e. the welt cloth, and the second panel is composed of flexible material and is provided with a linear formation, e.g. a line of spaced perforations or a crease, near to and generally parallel to each edge. The contacting surfaces of the first and second panels are adhered to each other to form a combined panel having a thickness of both the first and second panels conjoined and a generally rectangular configuration of either the first or the second panels. The third thin panel is composed of cloth and has a linear tab along an edge, which tab is attached to the combined panel along an edge of the first panel side of the combined panel. The article of manufacture is attached to a cloth article in conjunction with a linear slit in the cloth article, to form the welt. The linear formation in the second panel facilitate the attachment of the article of manufacture to the cloth article, which is typically garment cloth used in the assembly of an article of clothing.

14 Claims, 8 Drawing Figures

FIG. 1
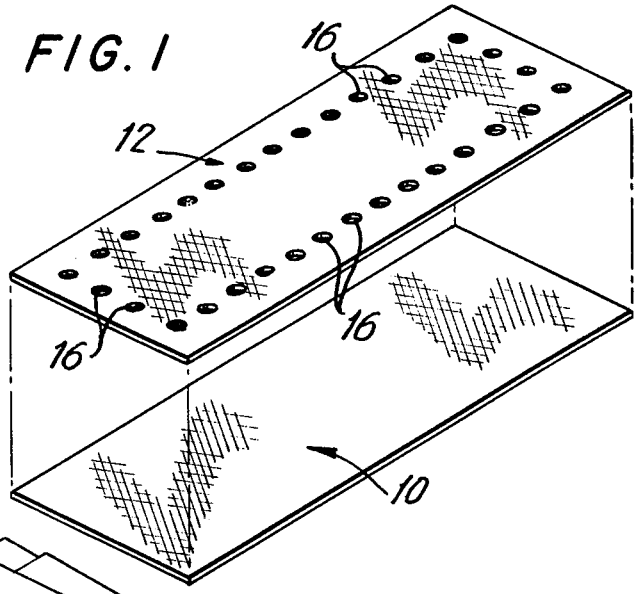
FIG. 2
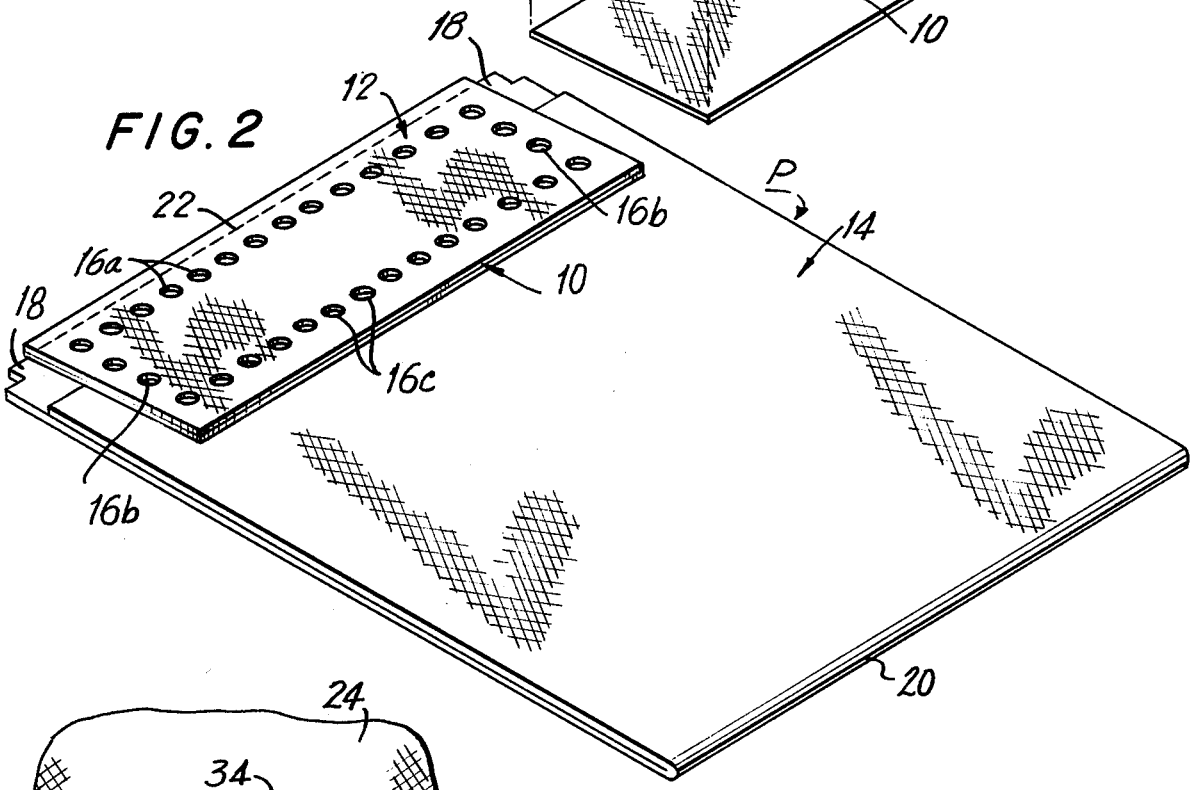
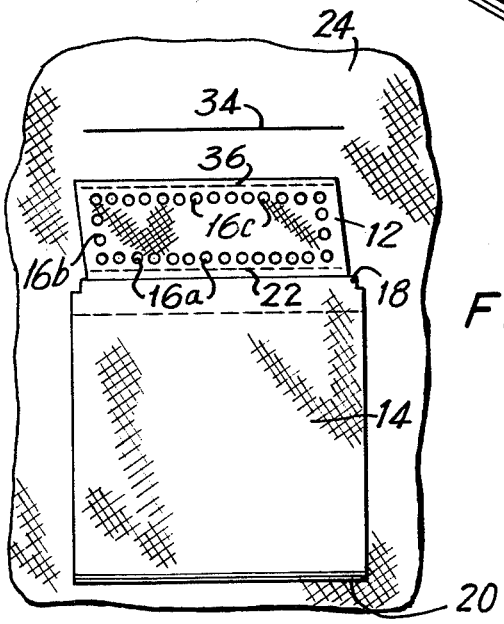
FIG. 3

FIG. 4
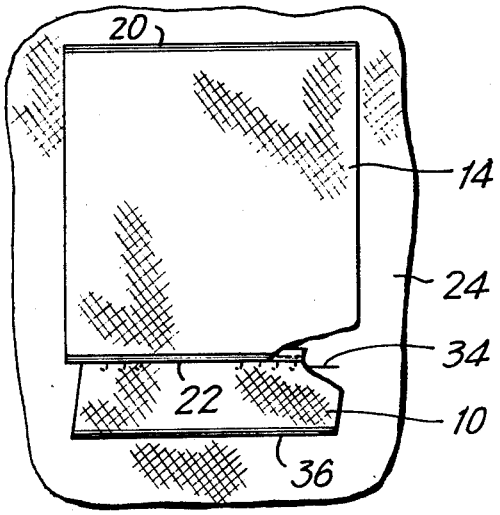
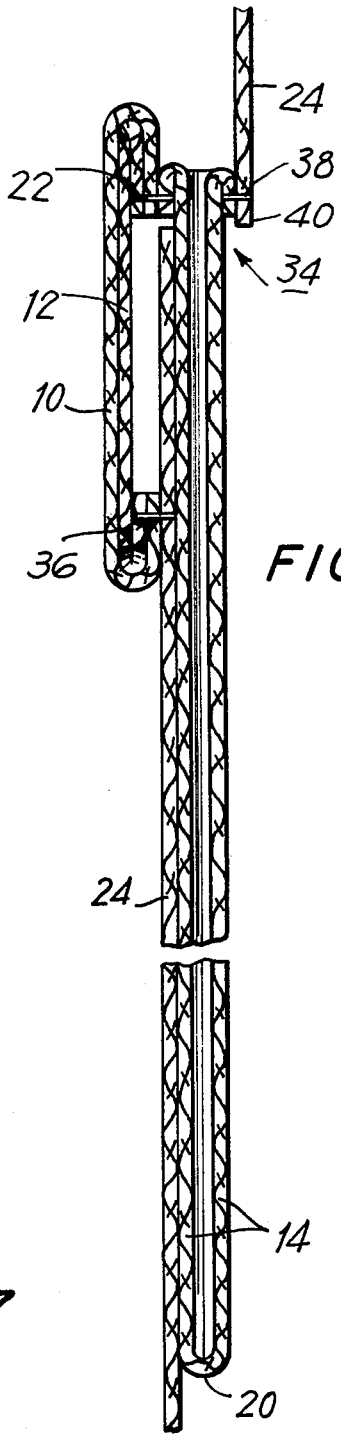
FIG. 6
FIG. 5
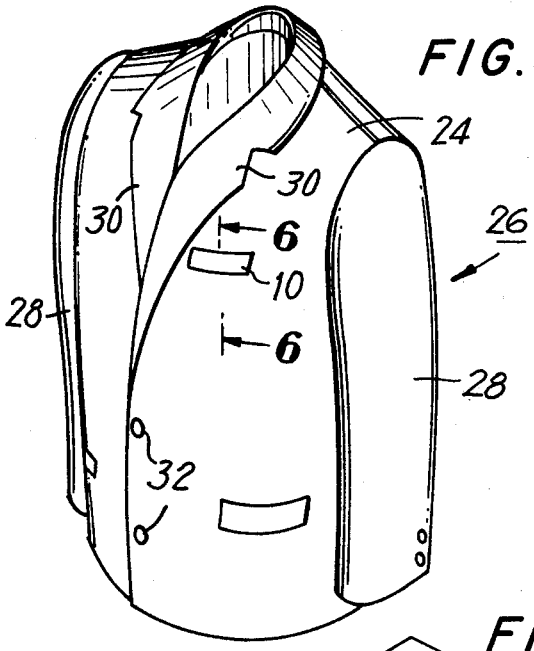
FIG. 7
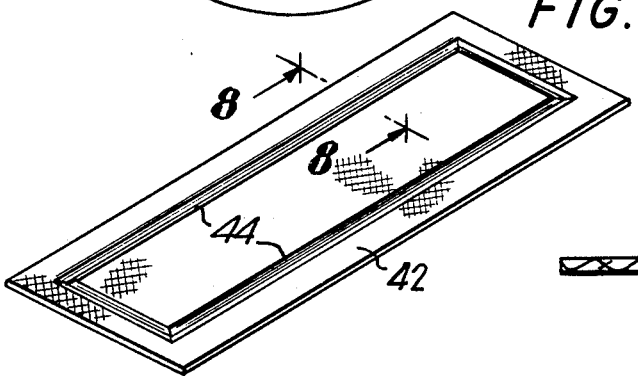
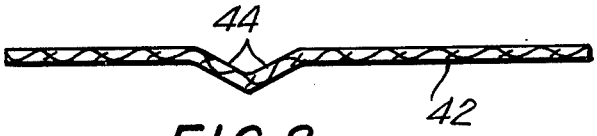
FIG. 8

WELT FOR CLOTH ARTICLES

BACKGROUND OF THE INVENTION

1. Field of the Invention

The invention relates to the provision of welts in cloth articles, e.g. a welt at the top of an inset pocket in an article of clothing: the invention also is applicable to patch pockets, and to the fronts of garments, or to other cloth articles.

2. Description of the Prior Art

The incorporation of welts in clothing is widely practiced, both for ornamental reasons and for strengthening and reinforcing an edge of the article of clothing such as a pocket on a coat or jacket.

In the traditional method of making a welt, after cutting the welt out of fabric, it is sewn onto the front of the garment, or anywhere on the garment where it belongs to serve the function of a pocket, either for use and/or for ornamentation. Also, the same steps are taken whether or not there is a variation of size or shape of the pocket.

Heretofore, when preparing a welt, a great number of individual and sequential steps were necessary which required hand labor and consumed time. First, the welt was sewn onto a piece of selesia or other lining material. Then, the corners of the welt were sewn down after the welt was bent up enough so that the selesia would not show when the welt was turned. The welt corners were then cut away or notched, so that the welt could be turned. Then the welt was turned. Next the welt was pressed. Thereupon the welt lining or selesia was slit on the side, or not slit, but marked, e.g. with chalk, for setting on the garment. All of these large number of steps entailed hand and machine operations which were costly in terms of time and labor, and which increased the cost of the finished goods, e.g. the article of clothing. It is well known that in the mass production of consumer items, small incremental savings in unit cost of manufacture add up to large annual savings and increased profit for the operation; hence any reduction, particularly a large reduction, in the number of operations performed to fabricate a welt that is ready for incorporation in an article of clothing, would be highly desirable.

SUMMARY OF THE INVENTION

1. Purposes of the Invention

It is an object of the present invention to provide an improved method of making a welt for cloth articles such as clothing.

Another object of the invention is to provide an improved article of manufacture for making a welt.

An additional object of the invention is to reduce the cost of manufacturing clothing or other cloth articles.

A further object of the invention is to reduce the time and labor involved in making welts for clothing or other cloth articles.

Still another object of the invention is to reduce the unit cost of making a welt.

Another object of the invention is to simplify the making of a welt.

Another object of the invention is to enable welts to be more accurately made in mass production, using a minimum of hand labor.

Another object of the invention is to enable welts to be more accurately and precisely emplaced in clothing or other cloth articles.

Another object of the invention is to enable welts to be more rapidly emplaced in clothing or other cloth articles.

These and other objects and advantages of the present invention will become evident from the description which follows.

2. Brief Description of the Invention

In the present invention, the improved method of making a welt for clothing or the like entails a relatively simple sequence of steps which include a distinctly novel feature in this field of art, namely the provision of a premarked guide panel provided with a linear formation; e.g. perforations or creases, which pre-marking serves as a guide line for the operator in sewing the welt into the cloth article, i.e. in sewing straight and accurately. The pre-marked panel is adhered to a cloth panel composed of welt fabric which is usually comparable to the cloth fabric of the cloth article, e.g. garment cloth.

The present method includes providing three panels. The first and second panels are thin and generally rectangular, and are preferably oblong. The first panel is composed of cloth, i.e. welt cloth comparable to the garment cloth. The second panel, which is a pre-marked guide panel mentioned above, is composed of a flexible material such as cloth, and is generally of about the same size as the first panel. A linear deformation, such as a line of spaced perforations which, individually, are preferably circular, or a crease, is provided in the second panel. The second panel may be impregnated with a synthetic thermoplastic for increased rigidity so that the second panel may be adhered to the first panel by the application of heat and pressure. The second panel also may include strands of a synthetic thermoplastic to enable adhesion to the first panel to be accomplished. It will be appreciated that other methods of adhesion, such as glueing using an epoxy glue or the like, may alternatively be employed, or a solvent can be lightly applied to the second panel to tackify the thermoplastic for the purpose of adhesion. The linear deformation is provided in the second panel near and generally parallel to each edge of the second panel. The first and second panels are arranged in coextensive relationship and the facing surfaces of the panels are adhered to each other so that a combined panel having a conjoint thickness of both the first and second panels is formed. The combined panel thereby is in a simple and speedy manner provided on one side with pre-markings, i.e. the linear deformations, these being derived from the second panel.

The third panel is composed of cloth, e.g. any desired weight of pocket fabric. The third panel has a linear tab or extension along one edge, formed, for example, by notching the two end corners of an edge of the third panel. An edge of the combined panel is approximately registered with the free edge of the tab, the two edges being approximately of the same length. The linear tab is attached to the combined panel with the exposed surface of the first panel side of the combined panel facing a surface of the third panel. The attachment preferably is made by sewing the tab to the combined panel. In accordance with the present invention, the linear deformation provides guidance for the operator in making the aforesaid attachment. The attachment is made in such a manner that the third panel depends from the edge of the combined panel in a parallel configuration, i.e. prior to subsequent bending or folding of the elements, at least a portion of the third panel is parallel with and overlaps the combined panel, with the free end of the tab being registered with the edge of the combined panel.

The aforementioned assemblage completes the formation of the new article of manufacture for making a welt for an article of clothing or any other article composed of cloth, such as cloth holders for shoes or tools, cloth racks of various types, cloth suitcases or bags such as handbags, etc.

With regard to the actual assemblage of the article of manufacture into the cloth article, a linear slit is formed in a cloth article such as garment cloth. The combined panel is aligned with the cloth article so that one linear deformation in the second panel is parallel to and spaced from the slit, with the first panel being contiguous with the cloth article. The combined panel is then attached to the cloth article by a first linear attachment, e.g. sewing, which first linear attachment is parallel with the aforementioned one linear deformation. In most instances, the linear attachment will coincide with its respective one linear deformation. The combined panel is then folded about the first linear attachment and towards the slit, and then the free end of the combined panel is folded about or around the edge of the slit. The assemblage is completed by attaching the free end of the third panel to the cloth article adjacent to the opposite side of the slit, and also by providing the usual peripheral or side attachments.

The method and article of the present invention provide several salient advantages. Many fewer assembly steps are practiced. The requisite time and labor involved in making welts for clothing or other cloth articles is sharply reduced, and thus the cost of manufacturing clothing or other cloth articles is lowered. The making of welts is simplified, and welts may be more accurately made using a minimum of hand labor. In addition, the present invention enables welts to be more accurately, precisely and rapidly emplaced in clothing or other cloth articles. Finally, the linear deformations in the second panel provide and facilitate guidance of the operator in accurately sewing or stitching, and the linear deformations cannot be accidentally obliterated, as in the case of chalk markings.

The invention accordingly consists in the features of construction, combination of elements, arrangement of parts and series of steps which will be exemplified in the method and articles hereinafter described and of which the scope of application will be indicated in the appended claims.

BRIEF DESCRIPTION OF THE DRAWINGS

In the accompanying drawings in which are shown various possible embodiments of the invention:

FIG. 1 is an exploded perspective view of the first and second panels;

FIG. 2 is a perspective view of the completed article of manufacture including all three panels;

FIG. 3 is a plan view which shows the article in conjunction with a slitted cloth article;

FIG. 4 is a plan view showing one of the steps of installation of the welt into the cloth article;

FIG. 5 shows finished welts in an article of clothing

FIG. 6 is an enlarged sectional view of a portion of FIG. 5, taken substantially along the line 6—6 of FIG. 5;

FIG. 7 is a perspective view which shows an alternate configuration of the second panel: and FIG. 8 is an enlarged sectional elevation view of a portion of FIG. 7, taken substantially along the line 8—8 of FIG. 7.

DETAILED DESCRIPTION OF THE PREFERRED EMBODIMENTS

Referring now in detail to FIGS. 1 and 2, a first welt panel 10, a second guide panel 12 and a third lining panel 14 are shown. The panels 10 and 12 are equal-sized thin oblong panels. Panel 10 is composed of cloth i.e. welt fabric, typically of a cloth that can be used as a welt for a pocket, that is to say, a cloth that is appropriate in weight, durability, appearance and compatability for external display as a part of a garment. Guide panel 12 is composed of any suitable limp, flexible material; typically it is a light weight, inexpensive cloth such as a loosely woven light open wave fabric; a felted cloth also is suitable, the appearance and durability of panel 12 being of no consequence because it will not be seen in the finished garment and only is employed as an easily applied and readily used guide for an operator in placement and securement of the welt panel and its associated lining panel on a garment. Panel 12 is provided with a linear deformation near and generally parallel to each edge, which in this case consists of linear rows of circular perforations 16. Panels 10 and 12 are coextensive and in registered alignment and are adhered to each other (FIG. 2) to form a combined panel of a conjoint thickness of both panels 10 and 12.

To simplify and expedite manual securement of the panels to each other, the ultimately concealed panel 12 may incorporate an activatable adhesive that for fast inexpensive use is heat-activatable. Thus, said panel may be coated or impregnated with a synthetic thermoplastic material, e.g. cellulose acetate butyrate, polyvinyl chloride or an acrylate. In lieu of this arrangement, the panel may include fibers or strands of such a thermoplastic. Thereupon when the panels are stacked and pressed with dry heat or steam they will be effectively united. If desired, either panel can be sprayed or coated with a liquid adhesive after which the panels are superposed, one on another and pressed under heat to evaporate the solvent in the liquid adhesive. Regardless of the method employed, the panel 12 with its linear markings is integrally joined to the panel 10 to act as a subsequent placement and sewing aid to an operator.

Panel 14 is also of cloth, e.g. pocketing fabric of appropriate weight and durability when the welt is to be part of a pocket of a garment (see FIG. 5). Panel 14 has a linear tab 18 along an edge. Conveniently the tab is formed in one piece with the panel 18 by cutting notches at the opposite ends of said edge of the panel 18. Preferably the length of the tab exceeds the length of the oblong combined panel 10/12. The panel 14 is shown folded along a line 20 in FIG. 2, said fold line 20 forming the bottom of a pocket of a garment (see FIG. 6). The combined panel 10/12 is attached to the linear tab 18 by a linear line 22 of sewing. Prior to applying the sewing 22, a longitudinal edge of the panel 10/12 is registered with an end edge of the panel 12; the line of sewing 22 being located near and parallel to the longitudinal and end edges of said panels 10/12 and 14. The first panel 10 is face to face with the pocket panel 14 by use of the line 16*a* of perforations as a guide for the operator. Desirably the end edges of the panel 10/12 is folded onto the back of the panel 12 using the lines of end perforations 16*b* as guides and then stitched in position to conceal the raw edges of the panel 10.

FIGS. 3 and 4 show the sequence of emplacing the assembly P onto a cloth article 24 which as shown in FIG. 5 is a breast portion of a jacket 26 provided with sleeves 28, lapels 30 and buttons 32.

A linear slit 34 (FIGS. 3 and 4) is formed in a suitable location in the portion 24. The assembly P is aligned relative to the slit 34 so that the one row 16c of spaced perforations is generally parallel to and spaced below the lower edge of the slit 34 (see FIG. 3). The first panel 10 side of the combined panel 10/12 is placed against the surface of the cloth article 24, so that the panel 12 is outermost, with the lining panel 14 depending from the line of sewing 22. The line 16c serves as an operator guide for placement. The combined panel 10/12 now is attached to the cloth article 24 by a linear row 36 of sewing which is parallel to the line 16c. As shown in FIG. 4, the combined panel 10/12 is then folded upwardly about 36 and over the slit 34, and as shown in FIG. 6, the free end of the combined panel 10/12 is folded about or adjacent to the edge of slit 34. Finally, as shown in FIG. 6, the combined panel is folded down about the line 16a, which is above the line of sewing 22, the free end of panel 14 is attached to the cloth article 24 by a line of sewing 38 adjacent to the upper side 40 of the slit 34, the pocket lining panel 14 is inserted into the slit, the end edges of the combined panel 10/12 are sewed to the cloth article 24 and the cloth article with the welt in place is pressed.

FIG. 7 and 8 show an alternative configuration of a second panel 42, in which the linear deformations are heat and pressure formed creases 44.

It thus will be seen that there are provided a welt preassembly for clothing or the like, a method of using the same and a garment including such preassembly as a finished welt all of which achieve the various objects of the invention and are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. A method of making a welt for clothing or the like which comprises providing a first substantially oblong welt panel, providing a second thin substantially oblong guide panel, said first and second panels being of substantially equal sizes, providing a linear deformation in said guide panel near and substantially parallel to each edge thereof, coextensively placing one of said panels on the other, adhering the facing surfaces of said panels to one another in registered alignment, so that a combined panel having a thickness of both said welt and said guide panels conjoined and a generally rectangular configuration equal to that of said panels is formed, providing a third pocket panel having a linear tab along an edge, placing said combined panel on said third panel with a long edge of said combined panel in substantial registration with an end edge of said third panel and with said welt panel against said pocket panel, sewing said linear tab to said combined panel along a first line between said registered edges and a nearby first linear deformation while using said linear deformation as a guide, forming a linear slit in a cloth article, so placing said combined panel with said cloth article that a second linear deformation parallel to said first linear deformation in said guide panel is substantially parallel to and spaced below said slit, with said welt panel facing said cloth article, attaching said combined panel to said cloth article by a second line of sewing parallel with said second linear deformation, folding said combined panel about said second line of sewing and above said slit, folding the free end of said combined panel about the edge of said slit, sewing the free end of said pocket panel to said cloth article adjacent to the opposite side of said slit, and inserting the pocket in the slit.

2. The method of claim 1 in which the linear deformations in the guide panel are lines of spaced perforations.

3. The method of claim 2 in which the perforations are circular.

4. The method of claim 1 in which the linear deformations in the guide panels are creases.

5. The method of claim 1 in which the second panel has strands including thermoplastic material and in which the welt and guide panels are adhered to one another by the application of heat and pressure.

6. The method of claim 1 in which the guide panel is impregnated with a thermoplastic plastic and in which the welt and guide panels are adhered to one another by the application of heat and pressure.

7. The method of claim 1 in which the guide panel is coated with a thermoplastic plastic and in which the welt and guide panels are adhered to one another by the application of heat and pressure.

8. A method of making a welt preassembly for clothing or the like which comprises providing a first substantially oblong welt panel, providing a second thin substantially oblong guide panel, said first and second panels being of substantially equal sizes , providing a linear deformation in said guide panel near and substantially parallel to each edge thereof, coextensively placing one of said panels on the other, adhering the facing surfaces of said panels to one another in registered alignment, so that a combined panel having a thickness of both said welt and said guide panels conjoined and a generally rectangular configuration equal to that of said panels is formed, providing a third pocket panel having a linear tab along an edge, placing said combined panel on said third panel with a long edge of said combined panel in substantial registration with an end edge of said third panel and with said welt panel against said pocket panel, and sewing said linear tab to said combined panel along a first line between said registered edges and a nearby first linear deformation while using said linear deformation as a guide.

9. A welt preassembly comprising a first substantially oblong welt panel, a second substantially oblong limp guide panel, said panels being of substantially equal sizes, said guide panel having a linear deformation adjacent each edge thereof, facing surfaces of said panels being coextensive and adheringly attached to each other in registered alignment to form a combined panel, a third pocket panel having a linear tab along an edge, said combined panel being superposed on said pocket panel with a long edge of said combined panel being registered with an end edge of said pocket panel and with said welt panel against said pocket panel, and a line of sewing joining said combined panel to said pocket panel, said line being located between said registered edges and a nearby linear deformation.

10. The preassembly of claim 9 in which each linear deformation in the guide panel is a line of spaced perforations.

11. The preassembly of claim 10 in which the perforations are circular.

12. The preassembly of claim 9 in which each linear deformation in the guide panel is a crease.

13. The preassembly of claim 9 in which the guide panel is impregnated with a thermoplastic plastic.

14. The preassembly of claim 9 in which the guide panel is coated with a thermoplastic plastic.

* * * * *